US005178399A

United States Patent [19]

Garoutte

[11] Patent Number: 5,178,399

[45] Date of Patent: Jan. 12, 1993

[54] ARROW BROADHEAD WITH REMOVABLE SLICING TIP BLADE

[75] Inventor: Larry W. Garoutte, Austin, Tex.

[73] Assignee: YG, Inc., Austin, Tex.

[21] Appl. No.: 415,094

[22] Filed: Sep. 29, 1989

Related U.S. Application Data

[63] Continuation-in-part of Ser. No. 389,116, Aug. 2, 1989, Pat. No. Des. 326,889.

[51] Int. Cl.[5] ..... F42B 6/08

[52] U.S. Cl. ..... 273/422

[58] Field of Search ..... 273/422, 421

[56] References Cited

U.S. PATENT DOCUMENTS

| | | | |
|---|---|---|---|
| D. 209,283 | 11/1967 | Smith . | |
| D. 247,504 | 3/1978 | Trinkle . | |
| 2,005,424 | 6/1935 | Kindle et al. | 273/421 |
| 2,289,284 | 7/1942 | Chandler | 273/422 |
| 2,467,838 | 4/1949 | Lust et al. | 273/418 |
| 2,540,079 | 2/1951 | Ferguson . | |
| 2,568,417 | 9/1951 | Steinbacher | 273/421 |
| 2,676,017 | 4/1954 | Selent et al. | 273/421 |
| 2,888,264 | 5/1959 | Sharrar, et al. | 273/421 |
| 2,912,247 | 11/1959 | Doonan | 273/422 |
| 3,021,138 | 2/1962 | Smith | 273/422 |
| 3,756,600 | 9/1973 | Maleski | 273/422 |
| 3,915,455 | 10/1975 | Savora | 273/422 |
| 4,006,901 | 2/1977 | Simo | 273/422 |
| 4,036,499 | 7/1977 | Sherwin | 273/422 |
| 4,093,230 | 6/1978 | Simo | 273/422 |
| 4,099,720 | 7/1978 | Zeren | 273/421 |
| 4,146,226 | 3/1979 | Sorensen | 273/422 |
| 4,166,619 | 9/1979 | Bergmann et al. | 273/421 X |
| 4,175,749 | 11/1979 | Simo | 273/422 |
| 4,203,601 | 5/1980 | Simo | 273/422 |
| 4,210,330 | 7/1980 | Kosbab | 273/422 |
| 4,341,391 | 7/1982 | Anderson | 273/422 |
| 4,381,866 | 5/1983 | Simo | 273/422 |
| 4,410,184 | 10/1983 | Anderson | 273/422 |
| 4,452,459 | 6/1984 | Doonan | 273/422 |
| 4,505,482 | 3/1985 | Martin, Sr. | 273/421 |
| 4,643,435 | 2/1987 | Musacchia | 273/422 |
| 4,676,512 | 6/1987 | Simo | 273/422 |
| 4,781,386 | 11/1988 | Ammitage | 273/422 |

OTHER PUBLICATIONS

*Archery*, Jan. 1977, p. 6 Eagle Broadhead.

Christopher Andrews, "Broadheads; There is a Difference!", *Petersen's Bowhunting*, 1988, 102–107. Dec. 1988.

"Shapespearse's Thunderbolt", *Field & Stream*, Jun. 1970, 140–141.

*Primary Examiner*—Paul E. Shapiro

*Attorney, Agent, or Firm*—Arnold, White & Durkee

[57] ABSTRACT

An arrow broadhead with two sets of cutting blades: a replaceable tip cutting blade mounted on a nose portion of the broadhead; and a set of ferrule blades placed behind the nose portion and individually removable from a ferrule body of the broadhead. Each ferrule blade can be either triangular or concave in shape with a concave blade configuration giving maximum arrow penetration into the target. Dual sets of blades promote maximum penetration and broadhead durability. Damaged cutting tip blades can be removed easily and replaced without displacing non-undamaged ferrule blades. Conversely, each ferrule blade can be individually removed without displacing the cutting tip blade. Because the dual sets of blades provide maximum penetration, the present invention promotes quicker, more humane kills.

15 Claims, 3 Drawing Sheets

Fig. 1
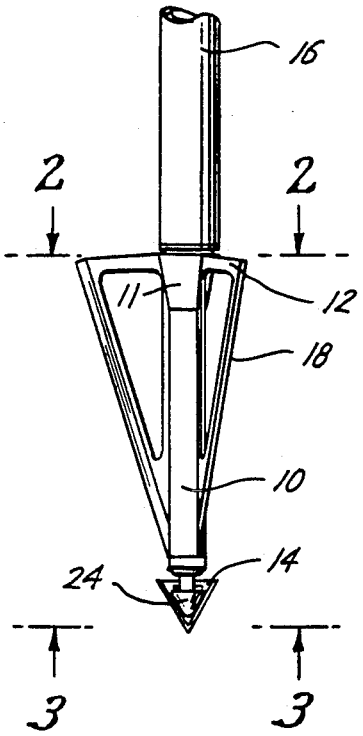
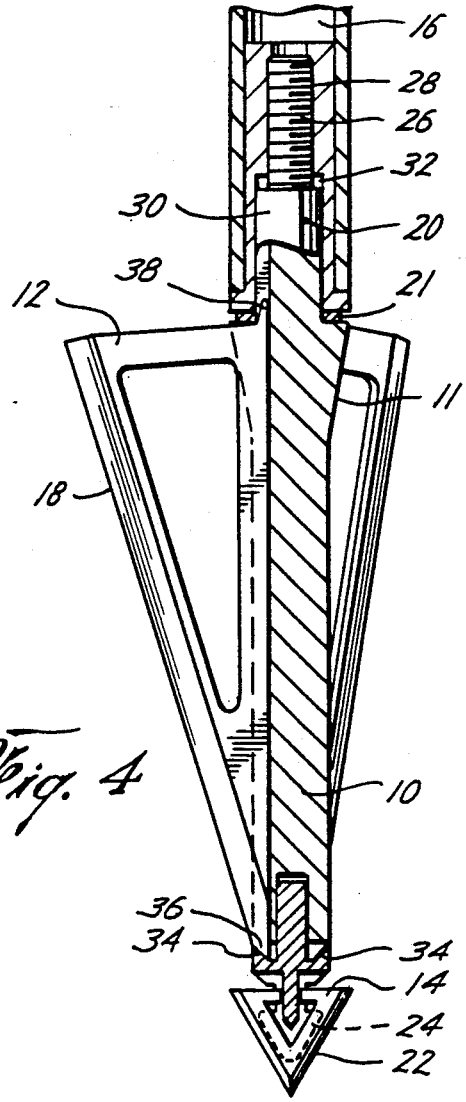
Fig. 4
Fig. 2
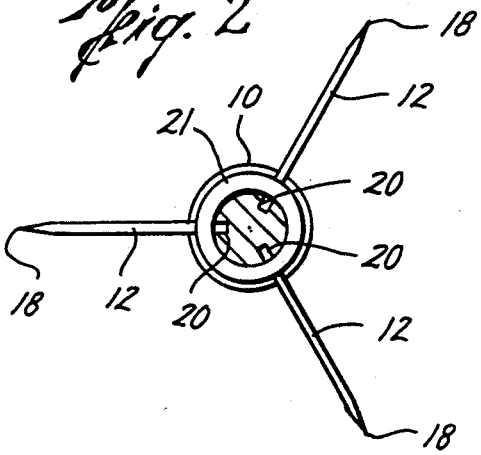
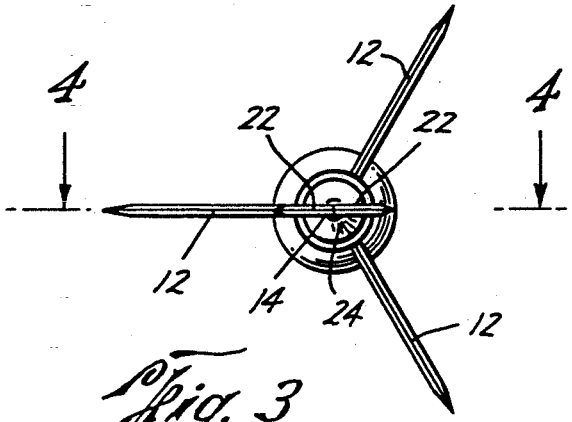
Fig. 3

ARROW BROADHEAD WITH REMOVABLE SLICING TIP BLADE

This application is a continuation-in-part application of Ser. No. 07/389,116, filed Aug. 2, 1989, U.S. Pat. No. D326,889.

BACKGROUND OF THE INVENTION

This invention relates to a hunting arrowhead incorporating a removable cutting tip blade with individually removable ferrule blades having straight or concave cutting edges.

Hunting arrowheads or broadheads are well-known in the art. Prior art broadheads with multiple and replaceable blades typically include a ferrule body for receiving ferrule blades of various sizes and shapes, and nose tips of various configurations which are attached to the forwardmost end of the ferrule.

Most broadheads have two to six ferrule blades with razor-sharp outer edges configured in an axially diverging pattern. The ferrule blades are typically configured in such a way as to maximize kill-efficiency and aerodynamic stability. Generally, the larger the ferrule blade surface area, the more the arrow tends to veer due to sideways air friction. Therefore, broadheads having numerous ferrule blades, three or more, are less aerodynamically stable than broadheads with fewer blades or less ferrule blade surface area, and tend to veer from the target area. In an effort to minimize their tendency to veer, ferrule blades are often designed with cutouts or vents to minimize the planar surface area of each blade. Also, vented blades are lighter than ventless, solid blades and thereby have a lesser projectory drop-off than the ventless variety. While broadheads having less than three vented blades are truer in flight than broadheads having four or more ventless blades, there are certain advantages of the large-surface area broadheads. First, more blades attached to a broadhead can provide greater kill-efficiency due to increased cutting of tissue. Second, ventless blades are stronger and more durable if blade material is thick enough and do not break easily when striking hard objects such as bone, rock or trees.

The kill-efficiency of the arrow is also affected by the tip design of the broadhead. Kill-efficiency of an arrow is best measured by its penetrability. At present, there are three types of tip configurations. First, a tip of simple conical design, which allows for the least penetration of the three. Second, a tip of pyramid design which has three or four sides, has slightly better penetrability than the conical design. Third are unibody nonreplaceable ferrule blades which extend along the entire length of the ferrule at an axially converging angle to a sharp cutting tip, and allow for maximum penetration.

Although cutting tip designs have maximum penetration, they suffer from lack of durability when compared to the other types of tip designs. When a cutting tip hits a hard surface, the extreme tip is often broken or deformed such that the broadhead is no longer usable. Since blades are permanently attached to the body of the ferrule in the unibody broadheads, detaching and replacing the ferrule blades in these types of broadheads are not possible.

SUMMARY OF THE INVENTION

The present invention utilizes two sets of blades incorporated within a dual-body broadhead construction. A cutting or slicing tip blade, having sharpened outside edges and a non-sharpened backside edge, is placed forwardmost on the broadhead. The cutting tip blade is engaged within a nose portion, which may be conical, such that the sharpened outside edge begins at a tip and extends radially backward. The cutting tip blade is removable by sliding the cutting tip blade forward and out of slots placed radially within the nose portion. A new cutting tip blade can be inserted and secured within the nose slots by sliding the interior surface of the cutting tip blade backward into the nose slots.

Attached to and behind the nose portion is a ferrule body, which may be cylindrical in shape, containing a set of replaceable ferrule blades. The ferrule blades can be triangular similar to the cutting tip blade. However, each ferrule blade has only one sharpened, concave or straight, outer edge and two non-sharpened inside and backside edges. The inside edge of each ferrule blade is securable within slots radially placed in the ferrule body. The backside edge of each ferrule blade extends radially outward from the ferrule body substantially perpendicular to the axis of the ferrule body. The ferrule body thus contains a plurality of ferrule blades, each independently replaceable in the ferrule body. Moreover, the ferrule blades are replaceable independent from the cutting tip blade.

The detachable cutting tip blade combines the advantages of penetrability with durability. The cutting tip blade of the present invention allows for maximum penetration over other multiple replaceable blade broadheads, and can be advantageous over other multiple replaceable heads when hunting larger game or when the pull-strength of the hunter is limited. Also, since the cutting tip blades are easily replaceable, they can be removed and new cutting tip blades attached if the hunter misses his target and strikes a hard surface damaging the cutting tip blade, without the necessity of replacing the ferrule blades. Therefore, the replaceable cutting tip blade feature allows for the best of both worlds.

Thus, the present invention alleviates the necessity of having to throw away the entire broadhead if the tip blade is damaged. The cutting tip blade can be removed and replaced without displacing the ferrule blades. Removing only the cutting tip blade saves the expense of having to throw away the larger and expensive ferrule blades every time the broadhead tip blade is destroyed.

BRIEF DESCRIPTION OF THE DRAWINGS

FIG. 1 is a side-view of an arrow broadhead of the present invention with removable cutting tip blade.

FIG. 2 is a cross-sectional view of FIG. 1 taken through section 2—2.

FIG. 3 is a cross-sectional view of FIG. 1 taken through section 3—3.

FIG. 4 is cross-sectional view of FIG. 3 taken through section 4—4.

DETAILED DESCRIPTION OF THE PREFERRED EMBODIMENTS

Figure 5:
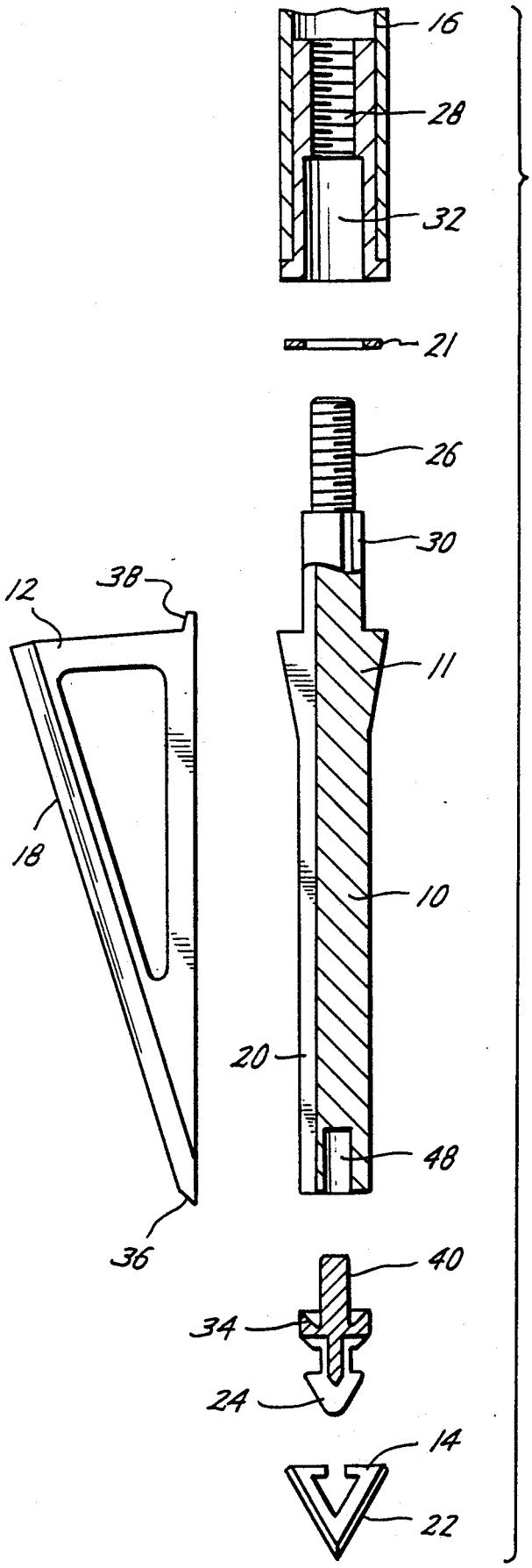
FIG. 5 is an exploded version of FIG. 4.

Referring to the drawings, FIG. 1 is a side View of an arrow broadhead of the present invention with a removable slicing tip blade. The broadhead includes ferrule body 10, three substantially triangular ferrule blades 12, nose portion 24 and substantially triangular slicing tip blade 14. The back end of ferrule body 10 is preferably threaded to the front end of arrow shaft 16, whereby threaded arrow shaft 16 functions to restrict radial and axial movement between ferrule blades 12 and ferrule body 10. Each ferrule blade 12 has a substantially straight sharpened outer edge 18 extending radially outward and backward along ferrule body 10 from the front end to the back end of ferrule body 10. Ferrule body 10 may be substantially cylindrical, or may exhibit a flared portion 11 which is such that the trailing end of ferrule body 10 is larger in diameter than the leading end.

FIG. 2 is a cross-sectional view through section 2—2 of FIG. 1. Three ferrule blades 12 are shown, each blade having sharpened outer edge 18. Each ferrule blade 12 is placed in a respective slot 20 extending radially into ferrule body 10 and having a length equal to that of ferrule body 10. Ferrule blades 12 are secured within slots 20 by washer 21 pressed against the backside edge of ferrule blades 12.

FIG. 3 is a cross-sectional view through section 3—3 of FIG. 1. Slicing tip blade 14 is preferably aligned in the same plane as one of ferrule blades 12 for maximum penetrability of the arrow into the target. Slicing tip blade 14 functions to easily open a small slice of tissue into the target prey allowing larger ferrule blades 12 to follow and deeply penetrate the target. Slicing tip blade 14 is preferably triangular in shape having two forward cutting edges 22 facing forward from nose portion 24 secured to the front end of ferrule body 10.

FIG. 4 is a view through section 4—4 of FIG. 3 showing the arrow broadhead with removable cutting tip blade and ferrule blades of the present invention. Ferrule body 10 has threaded portion 26 located at the back end of ferrule body 10 attachable to threaded cavity 28 located at the forward end of arrow shaft 16. A cylindrical backward extension 30 is also partially engaged in a cylindrical cavity 32 at the front end of the arrow shaft 16.

Nose portion 24 is also attached to the forwardmost end of ferrule body 10. Nose portion 24 is preferably press fit into ferrule body 10, however any suitable attachment means, such as threading, can be used. Nose portion 24 has undercut region 34 which substantially conforms to tapered region 36 at the front end of each ferrule blade 12. By rotating threaded arrow shaft 16 clockwise onto ferrule body 10, washer 21 compresses against the backside edge of ferrule blade 12 thereby forcing ferrule blade tapered region 36 secure within tapered undercut region 34. Thus, tapered undercut region 34 and washer 21 function together to secure ferrule blades 12 within the ferrule slots 20. Protrusion region 38 located at the backside edge of each ferrule blade 12 extends axially and also extends radially from the inside edge of each ferrule blade 12 to a point substantially flush with the outer surface of ferrule body 10. Protrusion 38 ensures that ferrule blades 12 will remain secure within ferrule slots 20 and will not become dislodged upon retraction of the arrow from its target. Both protrusion 38 and tapered region 36 are of sufficient strength to withstand arrow-to-target impact.

FIG. 5 is an exploded version of FIG. 4 showing the various components of the arrow broadhead with removable slicing tip blade of the present invention. Ferrule blade 12 is shown with cutting edge 18 protrusion 38 and tapered region 36. The inside edge of ferrule blade 12 is securable within slot 20 radially placed inward into ferrule body 10 and secured within slot 20 by washer 21 engaged against the backside surface of ferrule body lo. Once nose portion 24 is attached at the front end of ferrule body 10, ferrule blades 12 are secured within ferrule slots 20 by the threading of arrow shaft 16 onto ferrule body 10.

Figure 6:
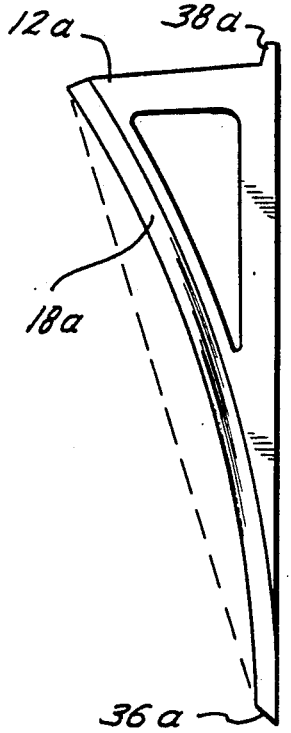
FIG. 6 is an alternative embodiment of a ferrule blade of the present invention.

FIG. 6 illustrates a concave, removable ferrule blade **12*a* of an alternative embodiment of the present invention. Ferrule blade 12*a* has an outside cutting edge 18*a* of concave shape for maximum penetration into the target area. Concave blade 12*a* is removable from ferrule body 10 and attachable to ferrule body 10 by securing protrusion 38*a* and tapered region 36*a* into ferrule slots 20 similar to the actions described above with respect to ferrule blade 12. The unique concave cutting edge 18*a* maximizes penetration of the arrow into the target while maintaining maximum durability. As with triangular ferrule blade 12, concave ferrule blade 12*a* is light-weight (approximately 16** grains per blade) and of rugged durability.

Concave and triangular ferrule blades **12*a* and 12 and cutting tip blade 14 are preferably made of 301 half hard stainless steel, ferrule body 10 is preferably T-6 aircraft aluminum, and nose portion 24** is preferably carbon steel, although other materials, such as other metals or alloys, are also acceptable.

Figure 7:
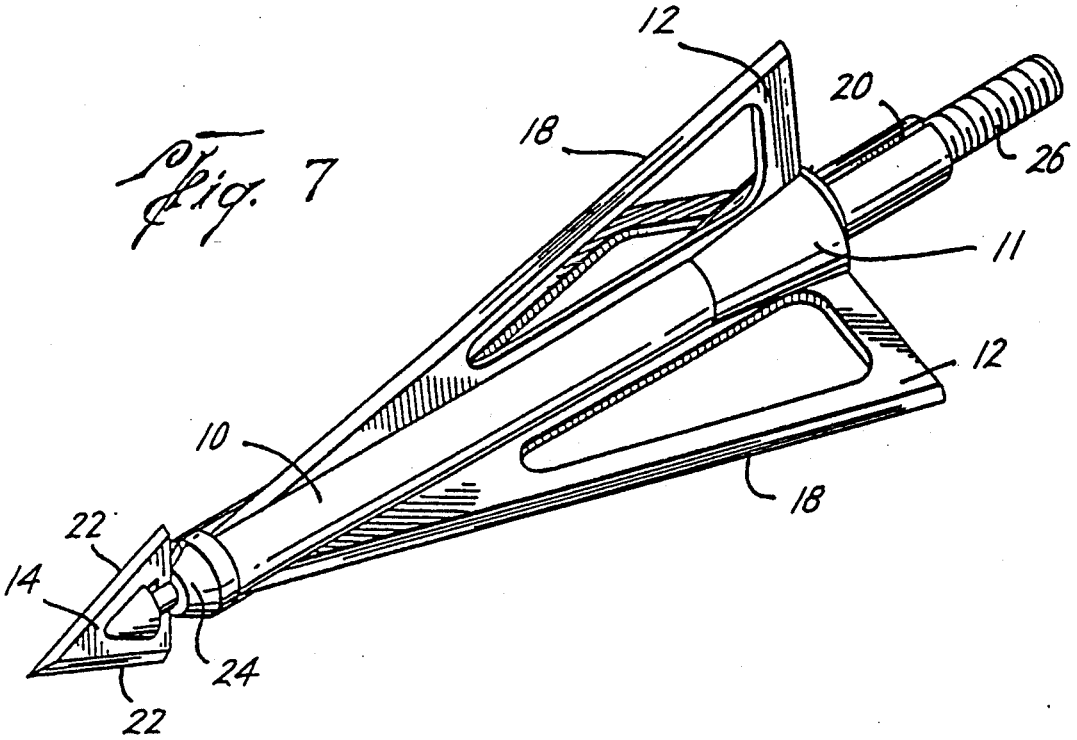
FIG. 7 is an isometric view of the present invention using straight-edged ferrule blades.
Figure 8:
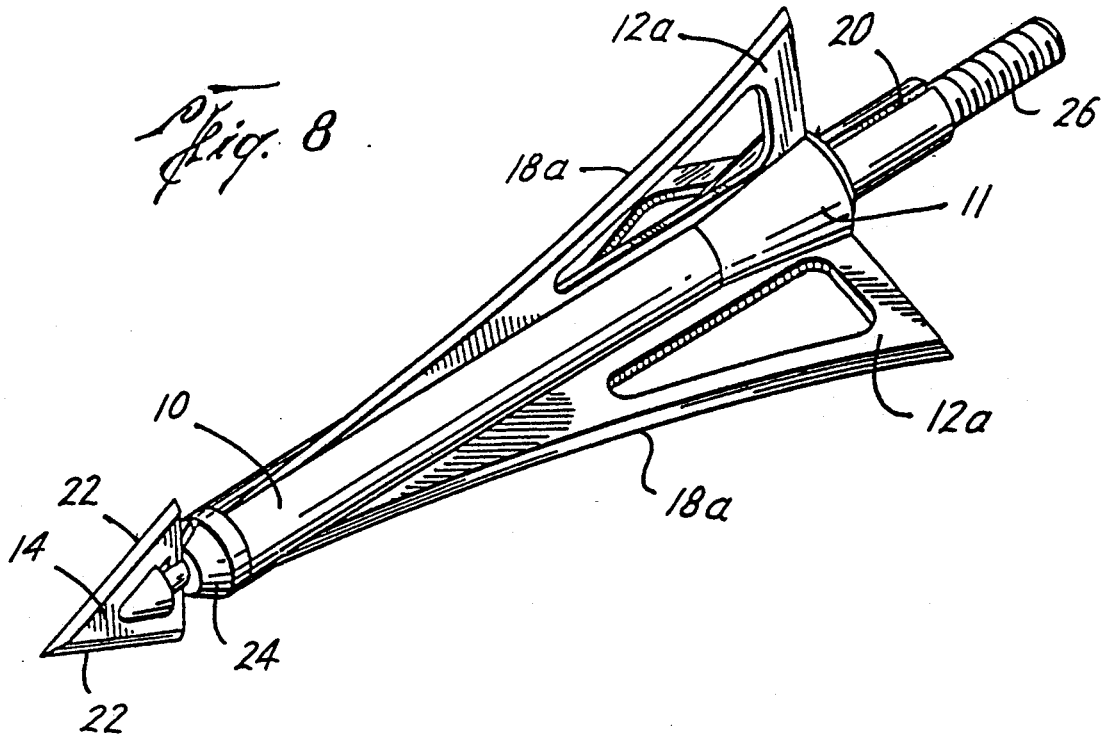
FIG. 8 is an isometric view of an alternative embodiment of the present invention using concave-edged ferrule blades.

Referring to FIGS. 7 and 8, which are isometric views of two embodiments of the present invention, shown in each figure are ferrule body 10 with flared portion 11, longitudinal slots 20 and threaded portion 26. Nose portion 24 is located at the front end of ferrule body 10, and carries slicing tip blade 14 with cutting edges 22.

The broadhead of FIG. 7 is fitted with straight-edged ferrule blades 12 having straight outside cutting edges 18, whereas the broadhead of FIG. 8 is fitted with concave-edged ferrule blades **12*a* having concave outside cutting edges 18*a***.

Although the disclosed embodiments have three removable ferrule blades, two or more ferrule blades can be used, the preferred number of ferrule blades being two to six. Similarly, although only one slicing tip blade is shown in the disclosed embodiments, more than one slicing tip blade can be used.

While the invention has been described with reference to the preferred embodiments, those of ordinary skill in the art will appreciate that changes, additions and/or deletions can be made to the preferred embodiment without departing from the scope of invention as defined by the appended claims.

What is claimed is:

1. An arrow broadhead comprising:

a ferrule body having a plurality of axially extending ferrule slots, each said ferrule slot extending radially into said ferrule body;

a removable ferrule blade engaged in each said ferrule slot, each ferrule blade having a front end and a rear end;

means for securing the front and rear ends of each ferrule blade within the respective ferrule slot of said ferrule body;

a nose portion attachable to a front end of said ferrule body, said nose portion having at least one nose slot extending from a front end to a back end of said nose portion, each said nose slot extending substantially radially into said nose portion; and a removable slicing tip blade engaged in each said nose slot, each said slicing tip blade being substantially triangular in shape with two sharpened outer edges and a backward edge, said backward edge extending substantially perpendicular to said back end of said nose portion.

2. An arrow broadhead according to claim 1, comprising three ferrule slots and three ferrule blades.

3. An arrow broadhead according to claim 1, wherein said nose portion includes two nose slots.

4. An arrow broadhead according to claim 1, wherein each said ferrule blade is substantially triangular in shape with a sharpened outer edge, an inner edge engaged in a respective ferrule slot and a backside edge extending substantially radially outward from said ferrule body, each said ferrule blade having a tapered region at a front end thereof, and a protrusion extending along the backside edge from the inside edge of said ferrule blade to a point flush with the outside surface of said ferrule body.

5. An arrow broadhead according to claim 4 wherein said means for securing includes: a tapered undercut in said nose portion to substantially match the tapered region at the front end of each of said ferrule blades; and a washer surrounding said ferrule body adjacent said rear end of each blade and engaging each of said protrusions.

6. An arrow broadhead according to claim 1, wherein each said ferrule blade includes a sharpened concave outer edge, an inner edge engaged in said ferrule slot, and a backside edge extending radially outward from said ferrule body.

7. An arrow broadhead according to claim 1, wherein each said ferrule blade and said cutting tip blade are made of 301 half hard stainless steel.

8. An arrow broadhead according to claim 1 wherein said slicing tip blade is aligned substantially coplanar with at least one of said ferrule blades.

9. A hunting arrow comprising:

an arrow shaft having a threaded cavity at its front end;

a ferrule body having a threaded tip at its back end for engaging said arrow shaft along a central axis of said shaft within the threaded cavity, said ferrule body having a plurality of longitudinally extending ferrule slots, each ferrule slot extending substantially radially into said ferrule body;

a removable ferrule blade engaged in each ferrule slot, each ferrule blade having a front end and a rear end;

means for securing the front and rear ends of each said ferrule blade within a respective ferrule slot of said ferrule body;

a nose portion attached to a front end of said ferrule body, said nose portion having at least one axially diverging nose slot extending from a front end to a back end of said nose portion, each said nose slot extending substantially radially into said nose portion; and a removable slicing tip blade engaged in each said nose slot, each said slicing tip blade being substantially triangular in shape with two sharpened outer edges and a backward edge, said backward edge extending substantially perpendicular to said back end of said nose portion.

10. A hunting arrow according to claim 9, wherein said securing means comprises:

protrusions formed at the rear end of each ferrule blade;

a washer axially fitable over both the threaded tip of the ferrule body, and the outside surface of said protrusions of each ferrule blade engaged in said ferrule slots, said washer engaging said ferrule body to secure the rear ends of said ferrule blades into said ferrule slots;

tapered portions at said front ends of each ferrule blade; and a tapered undercut in said nose portion to substantially match said tapered portions at said front ends of each ferrule blade.

11. A hunting arrow according to claim 9 wherein each said ferrule blade and said cutting tip blade are made of 301 half hard stainless steel.

12. A hunting arrow according to claim 9, said ferrule body having an axially diverging outside surface, a forward end of said ferrule body being of a lesser diameter than a rearward end of said ferrule body.

13. A hunting arrow according to claim 9, wherein said slicing tip blade is aligned substantially coplanar with at least one of said ferrule blades.

14. An arrow broadhead comprising:

a ferrule body having a plurality of longitudinally extending ferrule slots, each said ferrule slot extending into said ferrule body;

a removable ferrule blade engaged in each ferrule slot, each ferrule blade having a tapered region at the front end and a rear end, and having a sharpened concave outer edge, a substantially straight inner edge engaged in each said ferrule slot and a backside edge extending substantially radially outward from said ferrule body;

means for securing the front and rear ends of each said ferrule blade within a respective ferrule slot of said ferrule body;

a nose portion attachable to a front end of said ferrule body, said nose portion having a tapered undercut to substantially match the tapered region at the front end of said ferrule blade for engaging the front of each said ferrule blade with said ferrule body, and having at least one axially diverging nose slot extending substantially radially into said nose portion from a front end to a back end of said nose portion; and a removable slicing tip blade engaged in each said nose slot, each slicing tip blade extending forward of said back end of said nose portion.

15. An arrow broadhead according to claim 14 wherein said plurality of said ferrule slots and said concave blades each equal three in number.

* * * * *